US012691333B2

(12) United States Patent
Huh et al.

(10) Patent No.: US 12,691,333 B2
(45) Date of Patent: Jul. 28, 2026

(54) EXERCISE EQUIPMENT AND METHOD FOR CONTROLLING EXERCISE EQUIPMENT

(71) Applicant: LG ELECTRONICS INC., Seoul (KR)

(72) Inventors: Junyoung Huh, Seoul (KR); Youngshik Shin, Seoul (KR); Sungwon Beom, Seoul (KR); Taehee Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 96 days.

(21) Appl. No.: 18/704,090

(22) PCT Filed: Jun. 28, 2023

(86) PCT No.: PCT/KR2023/009020
§ 371 (c)(1),
(2) Date: Apr. 24, 2024

(87) PCT Pub. No.: WO2024/043483
PCT Pub. Date: Feb. 29, 2024

(65) Prior Publication Data

US 2024/0424344 A1 Dec. 26, 2024

(30) Foreign Application Priority Data

Aug. 22, 2022 (KR) ..... 10-2022-0104886
May 3, 2023 (KR) ..... 10-2023-0057700

(51) Int. Cl.
*A63B 24/00* (2006.01)
*A63B 71/06* (2006.01)

(52) U.S. Cl.
CPC ..... *A63B 24/0062* (2013.01); *A63B 71/0622* (2013.01); *A63B 2024/0093* (2013.01); *A63B 2220/20* (2013.01)

(58) Field of Classification Search
CPC ..... A63B 21/0053; A63B 21/153; A63B 21/4043; A63B 23/03541; A63B 23/1209;
(Continued)

(56) References Cited

U.S. PATENT DOCUMENTS 9,757,605 B2 9/2017 Olson et al.
11,324,983 B2 * 5/2022 Orady ..... A63B 21/015
(Continued)

FOREIGN PATENT DOCUMENTS

CA 2551734 4/2014
CN 110298221 10/2019
(Continued)

OTHER PUBLICATIONS

U.S. Office Action dated Aug. 12, 2025 issued in U.S. Appl. No. 18/206,799.
(Continued)

*Primary Examiner* — Megan Anderson
*Assistant Examiner* — Jonathan A Dicuia
(74) *Attorney, Agent, or Firm* — KED & ASSOCIATES, LLP

(57) ABSTRACT

Disclosed are exercise equipment and a method for controlling the exercise equipment including a main body forming an external shape of the equipment, an extendable/retractable wire that is disposed inside the main body and exposed to the outside of the main body, a load generator that provides a set load when the wire is extended/retracted, a power supply that supplies power to the load generator, and a controller that controls the power supply and the load generator. The method includes an exercise load setting of
(Continued)

setting the set load by determining the retraction of the wire while increasing a load generated by the load generator as the wire is extended, an exercise start determining of determining start of exercise based on the extension of the wire, an exercise load varying of reducing or increasing the load generated by the load generator based on a change in a length of the wire, and an exercise end determining of determining whether the exercise is in progress and whether the exercise is ended by sensing the length and the retracted state of the wire.

17 Claims, 9 Drawing Sheets

(58) Field of Classification Search
CPC ..... A63B 24/0062; A63B 24/0087; A63B 71/0622; A63B 2024/0093; A63B 2071/027; A63B 2220/13; A63B 2220/20; A63B 2220/805; A63B 2220/833; G16H 20/30; G16H 40/63; G16H 70/20
See application file for complete search history.

(56) References Cited

U.S. PATENT DOCUMENTS

| | | | | |
|---|---|---|---|---|
| 11,861,944 | B1 | 1/2024 | Yerushalmy | |
| 2002/0055419 | A1 | 5/2002 | Hinnebusch | |
| 2005/0075213 | A1 | 4/2005 | Arick | |
| 2010/0179028 | A1 | 7/2010 | Watterson et al. | |
| 2010/0267521 | A1 | 10/2010 | Matsunaga | |
| 2012/0237911 | A1 | 9/2012 | Watterson | |
| 2015/0080183 | A1 | 3/2015 | Alessandri et al. | |
| 2016/0250514 | A1 | 9/2016 | Gvoich | |
| 2019/0208114 | A1 | 7/2019 | Ginat | |
| 2019/0344123 | A1* | 11/2019 | Rubin | A63B 21/153 |
| 2020/0254295 | A1 | 8/2020 | Watterson | |
| 2020/0289891 | A1 | 9/2020 | Owusu | |
| 2020/0302617 | A1 | 9/2020 | Yabuki | |
| 2022/0008775 | A1 | 1/2022 | Rubin et al. | |
| 2022/0028518 | A1 | 1/2022 | Foley et al. | |
| 2022/0062738 | A1* | 3/2022 | Neuhaus | A63B 71/0622 |
| 2022/0072381 | A1 | 3/2022 | Trehan | |
| 2022/0111245 | A1 | 4/2022 | Gregory | |
| 2022/0128373 | A1 | 4/2022 | Lee | |
| 2022/0314071 | A1 | 10/2022 | Sauter | |
| 2023/0110715 | A1 | 4/2023 | David | |
| 2023/0405404 | A1 | 12/2023 | Belsham | |
| 2024/0009522 | A1* | 1/2024 | Huber | A63B 21/156 |
| 2024/0042281 | A1 | 2/2024 | Kashyap | |
| 2024/0149115 | A1 | 5/2024 | Yoon | |

FOREIGN PATENT DOCUMENTS

| | | |
|---|---|---|
| CN | 110298309 | 10/2019 |
| CN | 112512644 | 3/2021 |
| CN | 113762133 | 12/2021 |
| EP | 3108469 | 12/2019 |
| JP | 2007-226388 | 9/2007 |
| KR | 20-0326767 | 9/2003 |
| KR | 2015-0075988 | 7/2015 |
| KR | 10-2019724 | 9/2019 |
| KR | 10-2021-0028154 | 3/2021 |
| KR | 2022-0061511 | 5/2022 |
| KR | 10-2429323 | 8/2022 |
| WO | WO 2015/137566 | 9/2015 |
| WO | WO 2018/022465 | 2/2018 |
| WO | WO 2020/033508 | 2/2020 |
| WO | WO 2021/141186 | 7/2021 |
| WO | WO 2021/151127 | 8/2021 |
| WO | WO 2022/103278 | 5/2022 |
| WO | WO 2022/161037 | 8/2022 |
| WO | WO 2022/165551 | 8/2022 |

OTHER PUBLICATIONS

Fitness Equipment Café Tv: "Vitruvian Trainer+ First Look & Demo", Nov. 22, 2021 (Nov. 22, 2021), XP093315196 URL: https://www.youtube.com/watch?v=EU956QFQpuo.
European Search Report dated Oct. 7, 2025 issued in Application No. 23857521.1.
European Search Report dated Oct. 7, 2025 issued in Application No. 23857473.5.
PCT International Search report dated Jul. 28, 2023 issued in Application No. PCT/KR2023/005852.
PCT International Search report dated Aug. 3, 2023 issued in Application No. PCT/KR2023/005865.
PCT International Search report dated Aug. 21, 2023 issued in Application No. PCT/KR2023/005850.
PCT International Search report dated Oct. 17, 2023 issued in Application No. PCT/KR2023/009020.
U.S. Office Action dated May 8, 2026 issued in U.S. Appl. No. 18/719,556.

* cited by examiner

【FIG. 1】
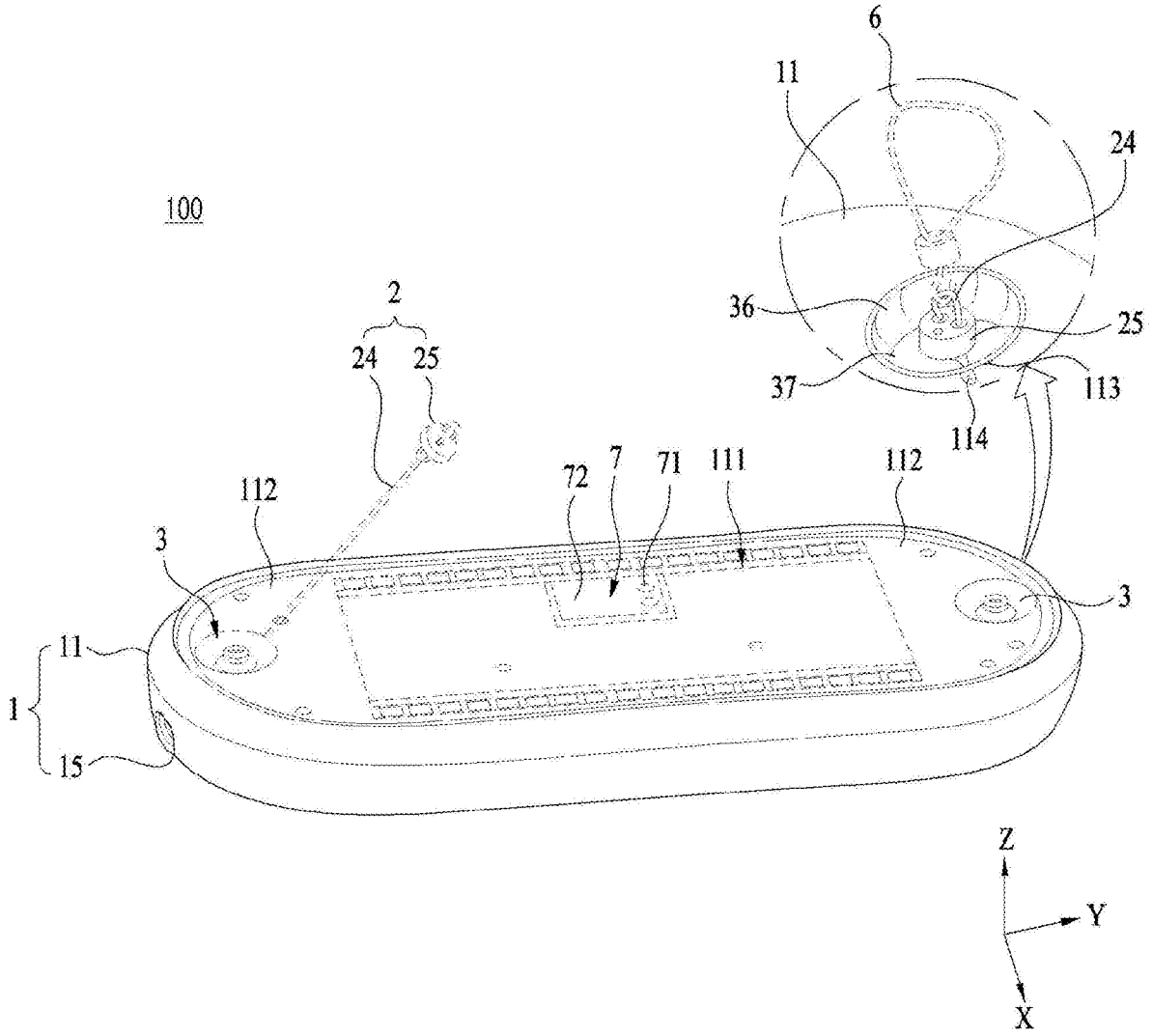

【FIG. 2】
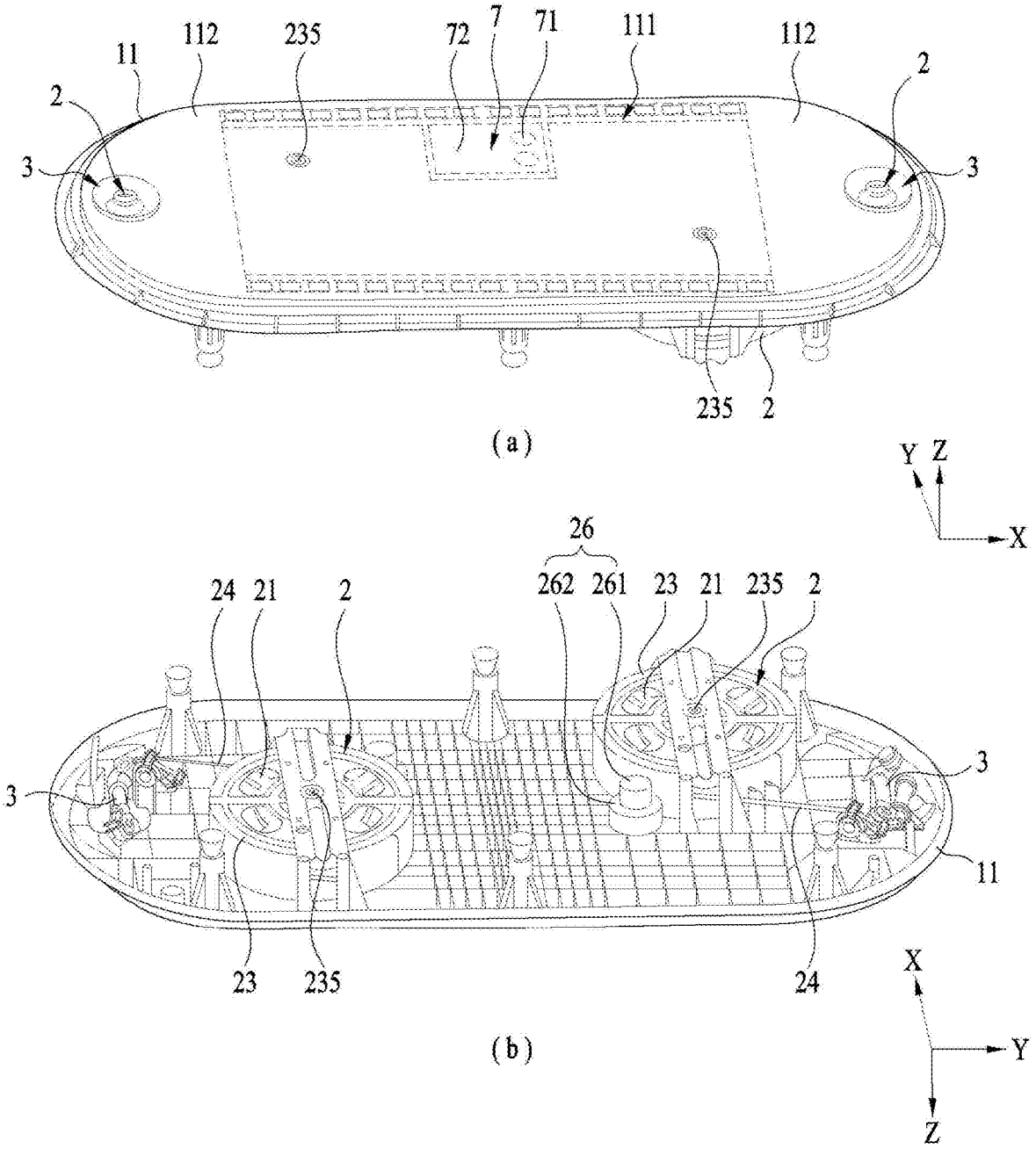

【FIG. 3】
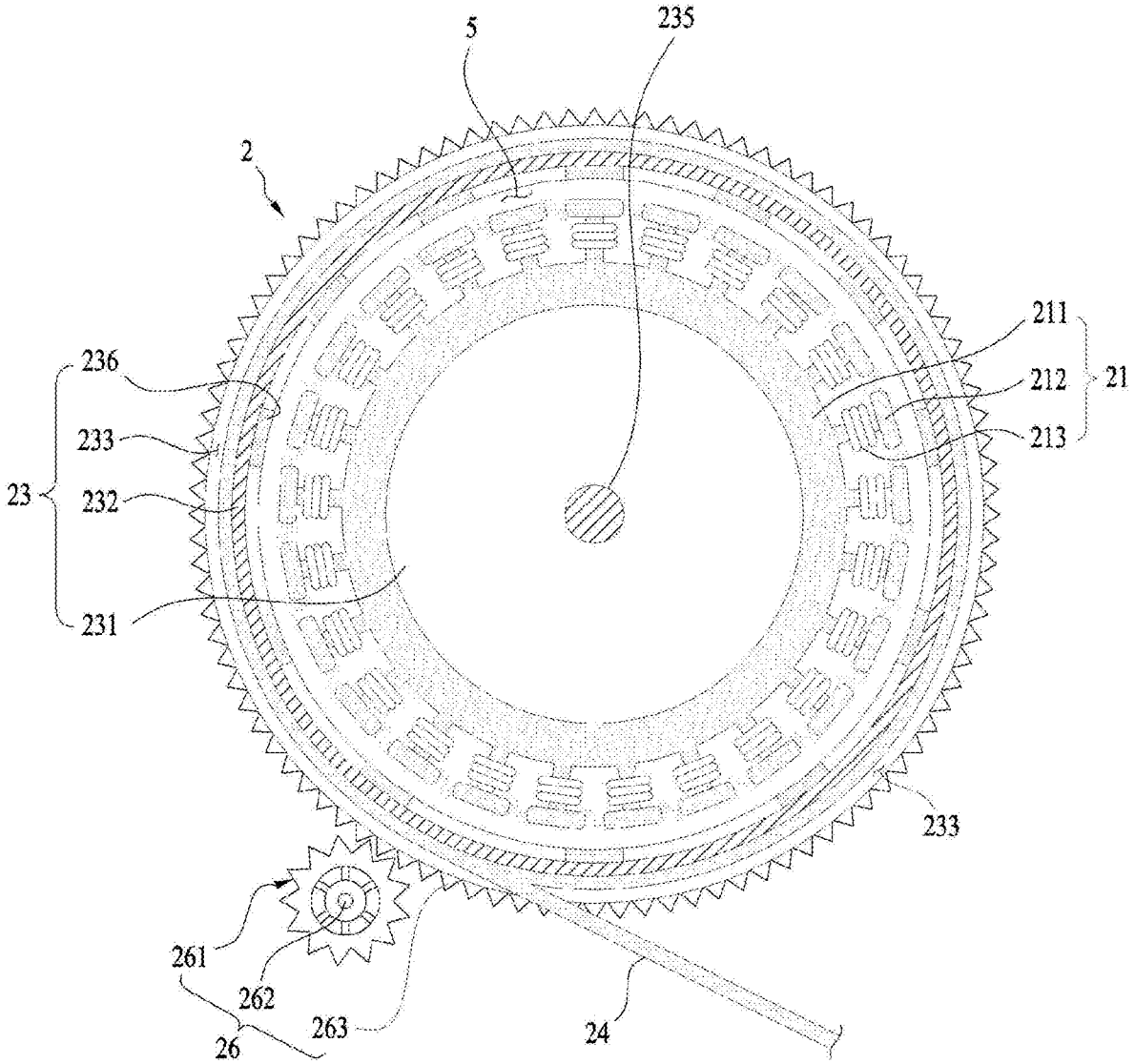

【FIG. 4】
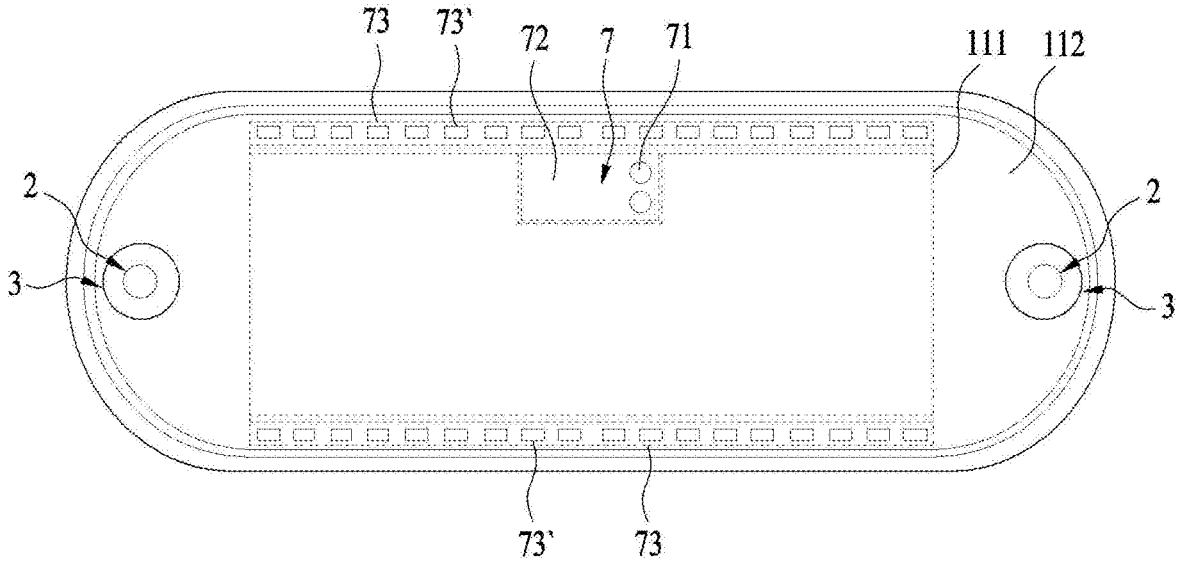

【FIG. 5】
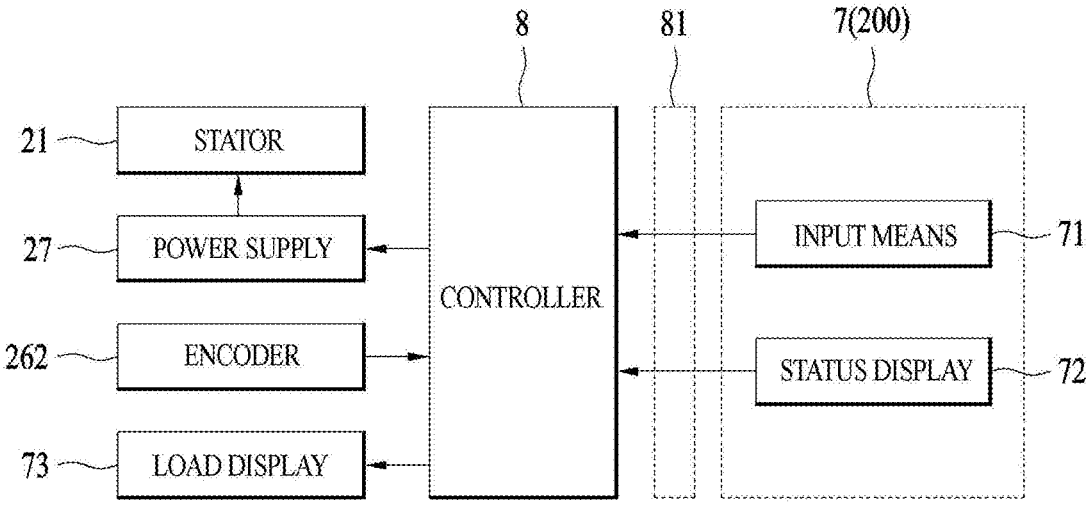

【FIG. 6】
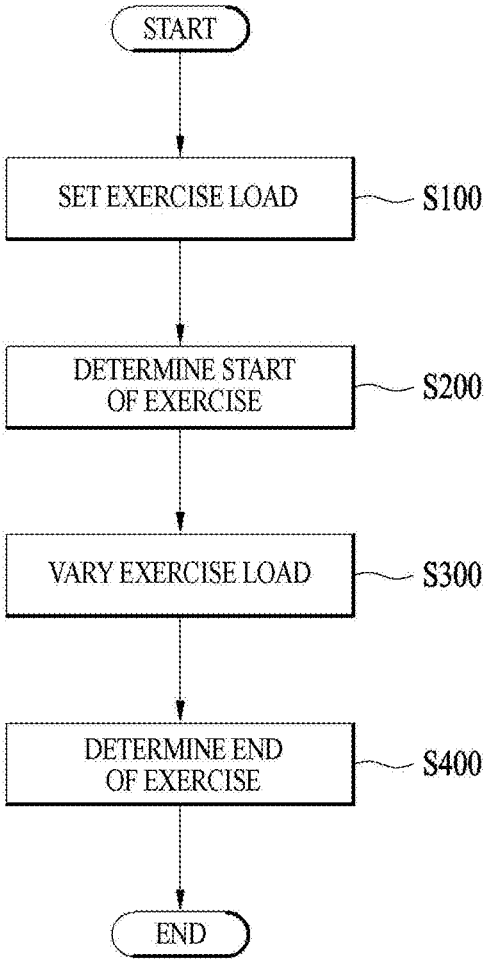

【FIG. 7】
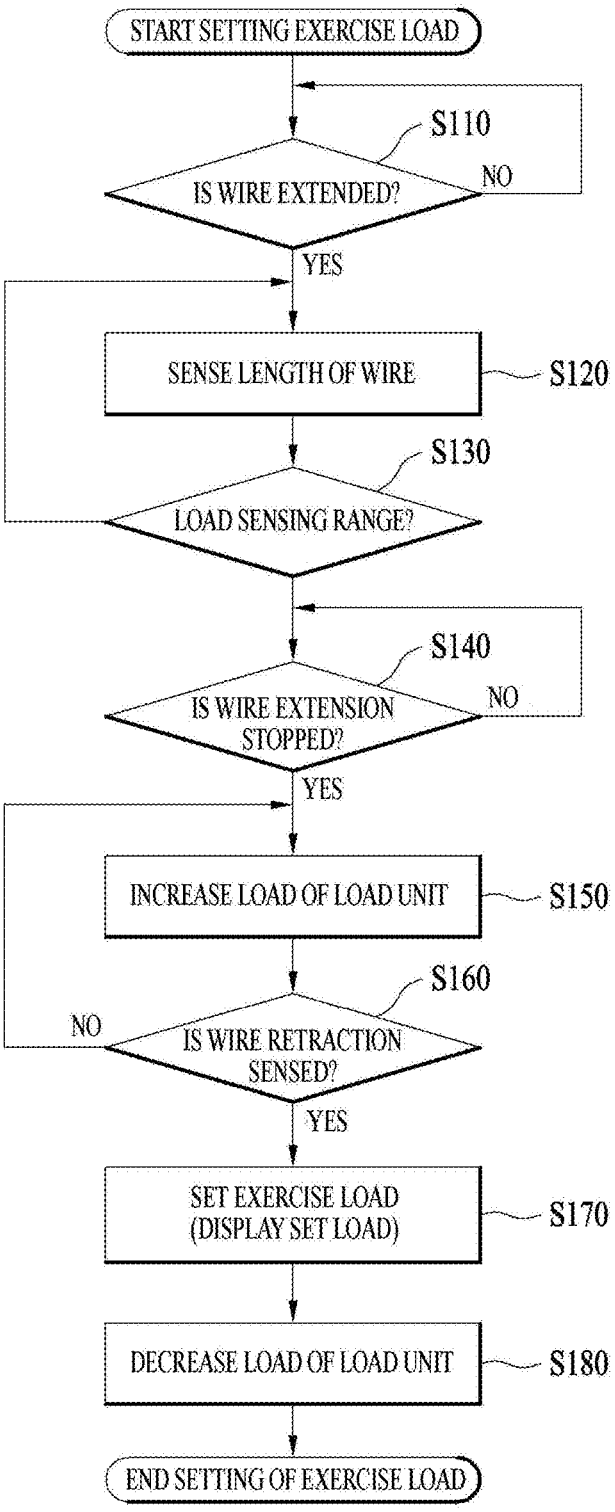

【FIG. 8】
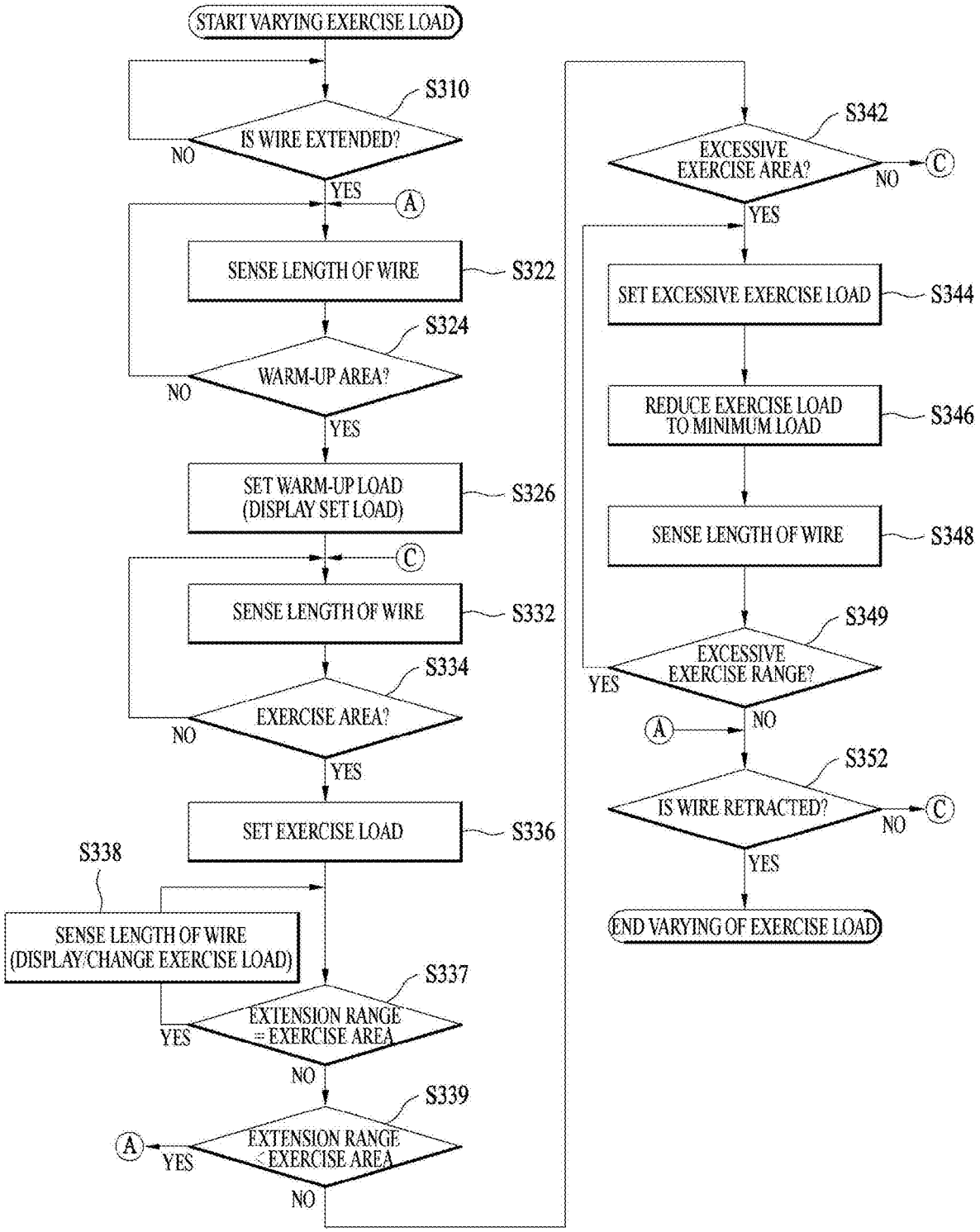

【FIG. 9】
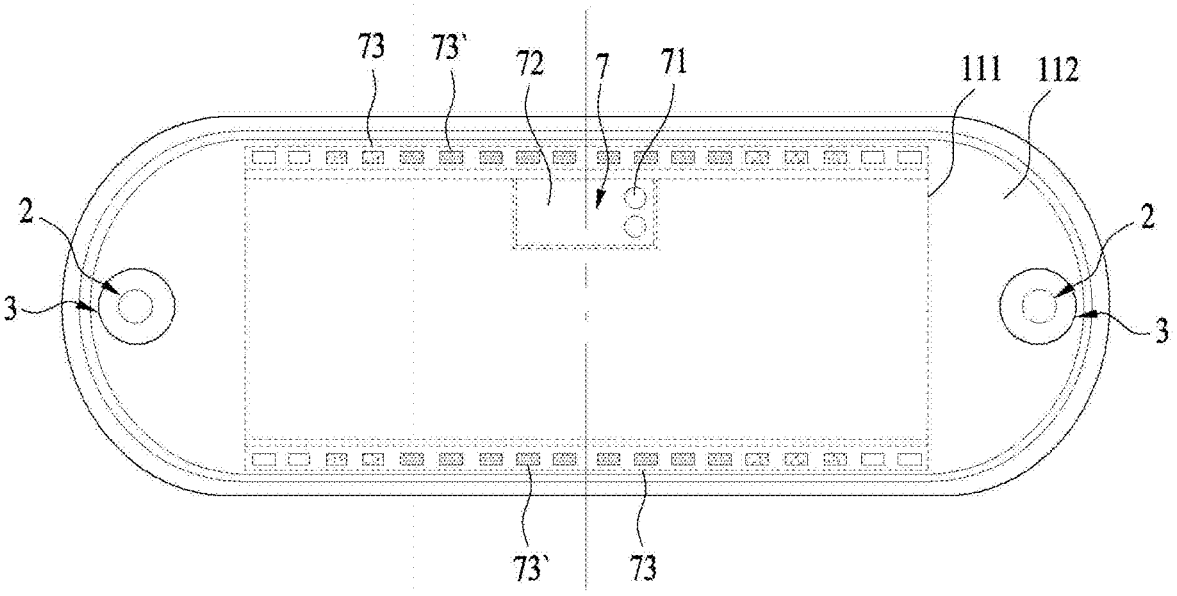

EXERCISE EQUIPMENT AND METHOD FOR CONTROLLING EXERCISE EQUIPMENT

CROSS-REFERENCE TO RELATED PATENT APPLICATIONS

This application is a U.S. National Stage Application under 35 U.S.C. § 371 of PCT Application No. PCT/KR2023/009020, filed Jun. 28, 2023, which claims priority to Korean Patent Application Nos. 10-2022-0104886, filed Aug. 22, 2022 and 10-2023-0057700, filed May 3, 2023, whose entire disclosures are hereby incorporated by reference.

TECHNICAL FIELD

The present disclosure relates to exercise equipment and a method for controlling the exercise equipment, and more specifically, to exercise equipment for controlling an extension/retraction load of a wire in the exercise equipment in which a user stands on a seating surface of a main body and extends/retracts the wire, and a method for controlling the exercise equipment.

BACKGROUND ART

In general, exercise equipment used for weight training is designed to repeat muscle relaxation and contraction while pushing or pulling a lever connected to a weight having a weight of a certain unit.

Such exercise equipment include various exercise equipment such as an arm curl machine for biceps exercise, a chest press or butterfly machine for chest exercise of a pectoralis major muscle or the like, and a pull-up machine for muscle exercise.

Recently, as part of self-management, home training to exercise alone at home without visiting a fitness center has become popular, and various exercise equipment for the home training have been proposed in line with such trend.

Among the exercise equipment for the home training, there is exercise equipment, for example, mat-type exercise equipment, in which a user exercises while standing up on the corresponding exercise equipment.

In this regard, in the case of mat-type exercise equipment, the exercise is performed in a form in which a handle is connected to a wire extending upward and the handle is pulled. In this regard, the exercise is performed as the wire is repeatedly retracted into or extended from the mat-type exercise equipment in the exercise process.

Such mat-type exercise equipment using the wire enables the exercise by actively applying resistance as much as an external force applied by the user based on a target load set by the user.

That is, a driver composed of a driving motor and the like generates and provides a virtual output load based on the target load set by the user of the exercise equipment, and generally gives feedback on the output load based on location information of the exercise equipment.

Unlike general exercise equipment for rehabilitation, the exercise equipment for the home training generates the output load using the high-output driver because of a nature of the exercise. In this regard, the exercise equipment has own dynamic characteristics, such as the high-output driver and a driving force transmitter for transmitting the output of the driver to the user.

Therefore, because of the dynamic characteristics of the exercise equipment itself, the output load (or a control input value) of the driver always generates a constant exercise load via the wire regardless of an intention of the user.

Therefore, in the case of the mat-type exercise equipment using the wire as described above, it is inevitable to exercise using the exercise load that is always the same. Moreover, as a muscle of the user is relaxed with an excessive load from the beginning without a process of relaxation after tension, a risk of injury may follow because of the excessive exercise load during the exercise.

In addition, in the case of the above-described mat-type exercise equipment using the wire, setting of the exercise load for performing the exercise and the exercise process are divided as separate processes, so that there is a cumbersome that the user has to set the exercise load separately and change a posture thereof to an exercise posture for the exercise to exercise.

In addition, in the case of exercise equipment using the wire as described above, because it is necessary to exercise with the exercise load that is always the same during the exercise process, the risk of injury may follow because of the excessive exercise load as the load is generated without considering variables such as the user's exercise posture, an exercise duration, and an exercise time point.

DISCLOSURE OF INVENTION

Technical Problem

The present disclosure was devised to solve the above problems, and is to provide exercise equipment and a method for controlling the exercise equipment that give an exercise load variable based on an extended/retracted length of a wire for the exercise equipment using the wire.

In addition, the present disclosure was devised to solve the above problems, and is to provide exercise equipment and a method for controlling the exercise equipment that may allow a user to more easily set an exercise load of the exercise equipment using a wire for the exercise equipment using the wire.

In addition, the present disclosure was devised to solve the above problems, and is to provide exercise equipment and a method for controlling the exercise equipment that may prevent injury of a user by varying an exercise load based on an extended/retracted length of a wire for the exercise equipment using a wire.

In addition, the present disclosure was devised to solve the above problems, and is to provide exercise equipment and a method for controlling the exercise equipment that may visually display, to a user, an exercise load applied to a wire or a load variation based on extension/retraction of the wire for the exercise equipment using the wire.

Purposes of the present disclosure are not limited to the above-mentioned purposes, and other purposes not mentioned above will be clearly understood by those skilled in the art from the description below.

Solution to Problem

A method for controlling exercise equipment including a main body forming an external shape of the equipment, an extendable/retractable wire that is disposed inside the main body and exposed to the outside of the main body, a load generator that provides a set load when the wire is extended/retracted, a power supply that supplies power to the load generator, and a controller that controls the power supply and the load generator according to one embodiment of the present disclosure for achieving the above purpose includes an exercise load setting of setting the set load by determining the retraction of the wire while increasing a load generated by the load generator as the wire is extended, an exercise start determining of determining start of exercise based on the extension of the wire, an exercise load varying of reducing or increasing the load generated by the load generator based on a change in a length of the wire, and an exercise end determining of determining whether the exercise is in progress and whether the exercise is ended by sensing the length and the retracted state of the wire.

The exercise load setting may include sensing the extension of the wire, sensing stop of the extension of the wire, increasing the load generated by the load generator, sensing the retraction of the wire, and setting the load of the load generator as the set load when the wire is retracted.

The sensing of the extension of the wire may include sensing that the wire is extended by a length corresponding to an exercise area corresponding to an exercise range of a user.

The sensing of the stop of the extension of the wire may include sensing that the extension of the wire is stopped for a predetermined period of time after the wire is extended by the length corresponding to the exercise area.

The increasing of the load generated by the load generator may include increasing the load at a constant speed from a minimum load of the load generator.

The sensing of the retraction of the wire may be performed during the increasing of the load generated by the load generator.

The sensing of the retraction of the wire may include reducing the load generated by the load generator to the minimum load when the retraction of the wire is sensed.

The sensing of the retraction of the wire may include setting a load generated by the load generator when the retraction of the wire is sensed as the set load.

The exercise equipment may further include a load display that quantitatively displays the set load thereon, and the set load may be displayed on the load display as being set.

The load display may include multiple LEDs arranged along an extension direction of the wire, and the set load may be displayed via sequential lighting of the LEDs.

An extended length of the wire may be divided into a warm-up area, an exercise area, and an excessive exercise area based on an exercise range of a user, and the exercise load varying of reducing or increasing the load generated by the load generator may include generating, by the load generator, a load smaller than the set load when the extended length of the wire is included in the warm-up area, generating, by the load generator, the set load when the extended length of the wire is included in the exercise area, and generating, by the load generator, a load greater than the set load when the extended length of the wire is included in the excessive exercise area.

The generating of the load smaller than the set load may include determining whether the extended length of the wire is included in the warm-up area and waiting until the extended length of the wire is included in the warm-up area.

The load generated by the load generator may have a magnitude within a range from 10 to 50% of a magnitude of the set load.

The exercise equipment may further include the load display including multiple LEDs arranged along an extension direction of the wire and quantitatively displaying the set load thereon, and the exercise equipment may display the load generated by the load generator in the warm-up area on the load display in a manner of overlapping the set load displayed on the load display.

The generating of the set load may include determining whether the extended length of the wire is included in the exercise area, and waiting while the wire is extended until the extended length of the wire is included in the exercise area.

The exercise equipment may further include the load display including multiple LEDs arranged along an extension direction of the wire and quantitatively displaying the set load thereon, and the exercise equipment may display the change in the length of the wire based on the extension and the retraction of the wire in the exercise area on the load display in a manner of overlapping the set load displayed on the load display.

In the generating of the load greater than the set load, when it is determined that the extended length of the wire is included in the excessive exercise area, the load generated by the load generator may have a magnitude within a range from 110 to 130% of a magnitude of the set load.

A load generated by the load generator after the generating of the load greater than the set load may be reduced in a magnitude to a magnitude within a range from 10 to 50% of the magnitude of the set load.

Exercise equipment according to one embodiment of the present disclosure for achieving the above purpose includes a main body forming an external shape of the equipment, an extendable/retractable wire that is disposed inside the main body and exposed to the outside of the main body, a load generator that provides a set load when the wire is extended/retracted, a sensor that senses an extended/retracted length of the wire, a control panel that inputs and displays a load condition of the load generator thereon, and a load display disposed on the main body and arranged in a direction parallel to an extension and retraction direction of the wire, wherein the load display quantitatively displays a set load generated by the load generator thereon.

The load display may display the extended/retracted length of the wire thereon in a manner of overlapping the set load quantitatively displayed on the load display based on the extended/retracted length of the wire sensed by the sensor.

Advantageous Effects of Invention

According to the exercise equipment and the method for controlling the exercise equipment according to the embodiment of the present disclosure, the method for controlling the exercise equipment that gives the exercise load variable based on the extended/retracted length of the wire may be provided for the exercise equipment using the wire.

In addition, the exercise equipment and the method for controlling the exercise equipment according to the embodiment of the present disclosure may provide the method for controlling the exercise equipment that may allow the user to more easily set the exercise load of the exercise equipment using the wire for the exercise equipment using the wire.

In addition, according to the exercise equipment and the method for controlling the exercise equipment according to the embodiment of the present disclosure, the method for controlling the exercise equipment that may prevent the injury of the user by varying the exercise load based on the extended/retracted length of the wire may be provided for the exercise equipment using the wire.

In addition, according to the exercise equipment and the method for controlling the exercise equipment according to the embodiment of the present disclosure, the exercise equipment and the method for controlling the exercise equipment that may visually display, to the user, the exercise load applied to the wire or the load variation based on the extension/retraction of the wire may be provided for the exercise equipment using the wire.

Effects of the present disclosure are not limited to the effects mentioned above, and other effects not mentioned will be clearly understood by those skilled in the art from the description of the claims.

BRIEF DESCRIPTION OF DRAWINGS

FIG. 1 is a perspective view showing exercise equipment according to an embodiment of the present disclosure.

FIG. 2 (*a*) and (*b*) are exploded perspective views showing exercise equipment according to an embodiment of the present disclosure.

FIG. 3 is a simplified diagram showing a load unit in exercise equipment according to an embodiment of the present disclosure.

FIG. 4 is a plan view showing exercise equipment according to an embodiment of the present disclosure.

FIG. 5 is a block diagram showing exercise equipment according to an embodiment of the present disclosure.

FIG. 6 is a flowchart showing an exercise process using exercise equipment according to an embodiment of the present disclosure.

FIG. 7 is a flowchart showing setting of an exercise load of exercise equipment according to an embodiment of the present disclosure.

FIG. 8 is a flowchart showing varying of an exercise load of exercise equipment according to an embodiment of the present disclosure.

FIG. 9 is an exemplary view showing an operation of a load display based on an exercise load of exercise equipment according to an embodiment of the present disclosure.

BEST MODE FOR CARRYING OUT THE INVENTION

Hereinafter, exercise equipment and a method for controlling the exercise equipment according to an embodiment of the present disclosure will be described in detail with reference to the accompanying drawings.

In describing the present disclosure, a name of each defined component is defined in consideration of a function in the present disclosure. Therefore, it should not be understood as limiting a technical component of the present disclosure. In addition, each name defined for each component may be referred to as a different name in the art.

First, with reference to the accompanying drawings, the exercise equipment according to an embodiment of the present disclosure will be described in detail.

FIG. 1 is a perspective view showing exercise equipment according to an embodiment of the present disclosure, FIG. 2 is an exploded perspective view showing exercise equipment according to an embodiment of the present disclosure, FIG. 3 is a simplified diagram showing a load unit in exercise equipment according to an embodiment of the present disclosure, FIG. 4 is a plan view showing exercise equipment according to an embodiment of the present disclosure, and FIG. 5 is a block diagram showing exercise equipment according to an embodiment of the present disclosure.

As shown in FIG. 1, exercise equipment 100 may include a main body 1 with a seating surface 111 and a mounting surface 112, a load unit 2 equipped with a wire 24 extendable/retractable from/into the main body 1, a wire guide 3 fixed to the mounting surface 112 to support the wire 24, a controller 8 for controlling the load unit 2 based on the extension/retraction of the wire 24, a control panel 7 for inputting and displaying a load condition (e.g., a set load or an exercise load) of the load unit 2, and a power supply 27 for supplying power to each of the components.

The main body 1 may include an upper casing 11 with the seating surface 111 and the mounting surface 112, and a lower casing 15 to which the upper casing 11 is fixed.

The seating surface 111 may be constructed as a space where user's feet are supported, and the mounting surface 112 may be constructed as a space where the load unit 2 is located. FIG. 1 shows a case in which the mounting surface 112 is constructed as two spaces spaced apart from each other along a horizontal direction (a Y-axis direction) of the main body 1 with the seating surface 111 interposed therebetween as an example.

In one example, the control panel 7 may be disposed on one surface of the upper casing 11 as shown in FIG. 4. The control panel 7 may input and display the load condition (e.g., the set load or the exercise load) for the operation of the load unit 2.

Such control panel 7 may include input means 71 having a button, a knobs, or the like for inputting the load condition, and a status display 72 having an LED, an LCD, and the like for displaying the input load condition and an exercise status (e.g., an extended/retracted length X of the wire 24 or a load status).

Alternatively, the control panel 7 may include the main body 1 and a separate communication device (e.g., a mobile communication terminal or the like) 200. That is, a separate communication interface 81 connected to the controller may be disposed inside the main body 1 and the main body 1 may be connected to the communication device 200 via the communication interface 81. In this case, a touch display disposed in the communication device 200 may perform the functions of the input means 71 and the status display 72.

In addition, a load display 73 for displaying the load set by the user and a load change based on the extension of the wire 24 to the user may be disposed at one side or the other side of the upper casing 11 in a width direction.

In the embodiment of the present disclosure, a pair of wires 24 and a pair of load units 2 corresponding to both hands may be disposed such that the user may exercise using the both hands, and the user may exercise by extending the wire(s) 24 using one or both hands.

In this regard, the load display 73 may have multiple lighting means such as LEDs arranged in parallel at the one side or the other side of the upper casing 11 in the width direction, and therefore, as the user extends the wire, the LEDs of the load display 73 may be sequentially turned on, and the user's exercise status may be displayed.

In one example, the LEDs of the load display 73 may be RGB LEDs for rendering at least two colors. In this case, the load display 73 may display the set load and the exercise load by lighting the LEDs in different colors for the set load set by the user and the load change resulted from the wire extension of the user.

In addition, the load display 73 may display the variation of the load based on the extension of the wire 24 at the one side or the other side, corresponding to the pair of wires 24 and the load units 2 as described above. Therefore, the LEDs of the load display 73 may be arranged symmetrically with respect to a center of the upper casing 11.

The main body 1 may have a mounting surface through-hole 113 and a fastening hole 114 extending through the mounting surface 112 and in communication with the inside of the main body 1. The wire guide 3 may be fixed to the mounting surface 112 via the fastening hole 114 while being inserted into the mounting surface through-hole 113.

As shown in FIG. 2, each load unit 2 may include the wire 24 and load generators 21 and 23. The wire 24 may have one end located inside the main body 1 and the other end exposed to the mounting surface 112, and the load generators 21 and 23 may be located inside the main body 1 and fix one end of the wire 24.

The wires 24 may include a first wire extended/retracted from/into the main body via the portion of the mounting surface 112 located at the left side of the main body 1, and a second wire extended/retracted from/into the main body via the portion of the mounting surface 112 located at the right side of the main body 112.

The load generators 21 and 23 are means for generating a force that pulls the wire 24 into the main body 1. When the two wires 24 are disposed, there may be two pairs of load generators 21 and 23: a first load generator for providing a tensile force to the first wire; and a second load generator for providing a tensile force to the second wire. The first wire and the second wire may have the same structure, and the first load generator and the second load generator may have the same structure.

(*b*) in FIG. 2 shows a case in which each pair of load generators 21 and 23 include the stator 21 fixed to the upper casing 11 or the lower casing 15 to form a rotating field, and the rotor 23 rotatably fixed to the upper casing 11 or the lower casing 15 to rotate by the rotating field as an example.

As shown in FIG. 3, the stator 21 may include a core 211 formed in a ring shape and fixed to the upper casing 11, multiple core protrusions 212 protruding from a circumferential surface of the core in a direction away from a center of the core, and each coil 213 wound on each core protrusion.

The rotor 23 may include a rotating plate 231 rotatably fixed to the upper casing 11 via a rotor shaft 235, a circumferential surface 232 fixed to the rotating plate and surrounding the stator, and a magnet 236 fixed to the circumferential surface.

The stator 21 may be located in a receiving space S defined by the rotating plate 231 and the circumferential surface 232, and the magnet 236 may include multiple permanent magnets whose magnetic poles are alternately exposed. The permanent magnets should be fixed to the circumferential surface 232 so as to be located in the receiving space S.

The wire 24 is fixed to the rotor 23. A wire receiving portion 233 providing a space for receiving the wire 24 may be defined in the circumferential surface 232 of the rotor.

The load unit 2 may further include a sensor 26 that senses the extended/retracted length X of the wire 24. FIG. 3 shows a case in which the sensor 26 includes a rotor gear 263 disposed on the circumferential surface 232 of the rotor, a gear 261 connected to the rotor gear 263, and an encoder 262 for sensing a rotation angle of the gear 261 as an example.

The controller 8 may vary the load generated by the load generators 21 and 23 following the extended/retracted length X of the wire 24 based on the exercise load of the user via the control panel 7.

In this regard, the controller 8 may wait for the exercise load input of the user as the exercise equipment starts operating, and may control the power supply 27 and the load generator 2 based on the exercise load input by the user to vary the load applied to the wire 24 based on the user's extension/retraction of the wire 24.

The sensor 26 may sense the extended/retracted length X of the wire 24. That is, the sensor 26 may sense the length at which the wire 24 is extended/retracted based on the extension/retraction of the wire 24, and the controller 8 may vary the load generated by the load generators 21 and 23 by varying a current supplied from the power supply 27 based on the extended/retracted length X of the wire 24.

The wire guide 3 is means for controlling an extension/retraction direction of the wire 24, and the wire guide 3 is means for guiding the wire 24 in at least two different directions.

The power supply 27 may supply power for the operation of the controller 8, the load generators 21 and 23, and the control panel 7. The power supply 27 may receive separate external power (not shown) or may be constructed as a rechargeable battery (not shown) inside the main body 1.

In this regard, the power supply 27 may vary the current supplied to the stator 21 of the load generators 21 and 23 based on the exercise load set via the input means 71 to vary an amount of load applied to the wire 24.

Accordingly, the operation of the exercise equipment according to the embodiment of the present disclosure will be described in detail with an embodiment. Each element mentioned below should be understood with reference to the above description and drawings.

FIG. 6 is a flowchart showing an exercise process using exercise equipment according to an embodiment of the present disclosure, FIG. 7 is a flowchart showing setting of an exercise load of exercise equipment according to an embodiment of the present disclosure, FIG. 8 is a flowchart showing varying of an exercise load of exercise equipment according to an embodiment of the present disclosure, and FIG. 9 is an exemplary view showing an operation of a load display based on an exercise load of exercise equipment according to an embodiment of the present disclosure.

As shown in FIG. 6, a process in which the user uses the exercise equipment 100 may roughly include setting the set load of the exercise equipment 100 (step S100), sensing a start of operation of the exercise equipment 100 (step S200), performing the exercise based on the set load (step S300), and sensing an end of the operation of the exercise equipment 100 (step S400).

In this regard, in the setting of the set load of the exercise equipment 100 (step S100), the user may numerically input the set load of the exercise equipment 100 (i.e., a magnitude of the load for the user to exercise) by himself/herself via the input means 71 of the control panel 7.

Such input of the set load may be performed based on a user's selection, and there may be other various embodiments. Therefore, the input means 71 and the communication device 200 do not limit the embodiment of the present disclosure. It should be said that, when the exercise is performed by inputting the set load in the exercise equipment 100, this is included in the technical scope of the present disclosure.

Alternatively, in the setting of the set load of the exercise equipment 100 (step S100), the set load may be set by increasing the load applied to the wire 24 by the load generators 21 and 23 as the user extends the wire 24 disposed in the exercise equipment 100 and sensing a degree to which the user withstands the load applied via the wire 24.

In one example, in one embodiment of the present disclosure, it will be described as an example that, in the setting of the set load of the exercise equipment 100 (step S100), the set load of the exercise equipment is set by increasing the load applied to the wire in a state in which the user has extended the wire 24. However, the setting of the set load of the present disclosure may not be limited, and the set load may be set via the control panel 7.

In one example, in the sensing of the start of the operation of the exercise equipment 100 (step S200), the user may input the operation of the exercise equipment 100 via the input means 71 of the control panel 7 to set the start of the operation of the exercise equipment 100.

Alternatively, in the sensing of the start of the operation of the exercise equipment 100 (step S200), as the user extends the wire 24 disposed in the exercise equipment 100 to use the exercise equipment 100, an encoder 262 of the sensor 26 in association with the load generators 21 and 23 may sense the extension of the wire 24 to determine the start of the operation of the exercise equipment 100.

In addition, in the performing of the exercise based on the set load (step S300), when the user extends the wire 24 to perform the exercise, the set load applied to the wire 24 may be varied as a warm-up status (i.e., a status in which the extended length of the wire 24 is relatively small), an exercise status (i.e., a status in which the extended length of the wire 24 is within an exercise range of the user), and an excessive exercise status (i.e., a status in which the extended length of the wire 24 is out of the exercise range of the user) are distinguished from each other based on the extended length of the wire 24. In this regard, the performing of the exercise based on the set load (step S300) will be described in detail with reference to a separate drawing.

In one example, in the sensing of the end of the operation of the exercise equipment 100 (step S300), as the user completely retracts the wire 24 disposed in the exercise equipment 100 to end the use of the exercise equipment 100, the sensor 26 in association with the load generators 21 and 23 may sense the retracted state of the wire 24 to determine the end of the operation of the exercise equipment 100.

Alternatively, the user may input the end of the operation of the exercise equipment 100 via the input means 71 of the control panel 7 to set the end of the operation of the exercise equipment 100.

Hereinafter, with reference to FIG. 7, the setting of the set load of the exercise equipment 100 (step S100) will be described in detail.

As shown, as the user stands on the seating surface 111 of the exercise equipment 100 to use the exercise equipment 100 and then extends the wire 24 in an exercise posture, the sensor 26 senses the extension of the wire 24 (step S110).

In one example, the controller 8 may sense the extended length of the wire 24 via the encoder 262 of the sensor 26 as the extension of the wire 24 is sensed (step S120). In this regard, the extended length of the wire 24 may correspond to an exercise area where the user exercises using the exercise load.

That is, in the case of the exercise equipment 100 equipped with the wire 24, when the user performs the exercise by extending the wire 24, the extended lengths of the wire 24 may be divided into an extended length of an initial process of extending the wire 24 to start the exercise (hereinafter, referred to as a 'warm-up area'), an extended length of the wire 24 for actually perform the exercise by extending the wire 24 (hereinafter, referred to as an 'exercise area'), and an extended length of the wire 24 at which it is difficult to perform the actual exercise because of the excessive extension of the wire (hereinafter, referred to as an 'excessive exercise area').

In one example, the extended lengths of the wire 24 for the aforementioned warm-up area, exercise area, and excessive exercise area may be set differently depending on a physical condition and an exercise condition of the user, but a certain range in which the wire 24 is extended initially may correspond to the warm-up area and a certain range before the wire 24 is completely extended may correspond to the excessive exercise area. Accordingly, a range between the extension range of the wire 24 corresponding to the warm-up area and the extension range of the wire 24 corresponding to the excessive exercise area may correspond to the exercise area.

In one example, when the user performs the exercise using the wire 24, based on the extension of the wire 24, the exercise area may be entered inevitably via the warm-up area, and the excessive exercise area may be entered after passing through the exercise area.

In this regard, there is no need to apply the load for performing the exercise using the wire 24 in the warm-up area, and there is no need to apply the load for performing the exercise using the wire 24 in the excessive exercise area because it is difficult to exercise using the wire because of the excessive extension of the wire 24.

Moreover, the exercise equipment 100 using the wire 24 is to perform the exercise using a reaction force based on the load acting on the wire 24. When the wire 24 is extended by a length corresponding to the excessive exercise area, the user may not be able to perform normal exercise because of difficulty in receiving the reaction force by the wire, and the exercise posture may be lost because of the excessive extension of the wire 24.

In one example, the controller 8 determines whether the extended length of the extended wire 24 corresponds to the exercise area as the extended length of the wire 24 is sensed, waits while the wire 24 is extended until the exercise area is reached, and waits for the extension of the wire 24 to stop when the extended length of the wire 24 corresponds to the exercise area (step S130).

Thereafter, the controller 8 determines whether the extension of the wire 24 by the user is stopped and the user waits. That is, the user may wait for a certain period of time (e.g., 3 to 5 seconds) in an initial posture of the exercise to perform the exercise using the wire 24. Therefore, the controller 8 determines that the user is ready to perform the exercise (step S140).

In one example, when the user maintains the exercise posture for a certain period of time, the controller 8 may set the set load for performing the exercise. The controller 8 controls the load generators 21 and 23 to gradually increase the load applied to the wire 24 from a minimum load at a constant speed to determine whether the user is able to withstand the load applied to the wire 24 (step S150).

That is, in performing the exercise using the wire 24, the user performs the exercise with the reaction force to the load applied to the wire 24. As the load applied to the wire 24 increases, the retraction of the wire 24 is performed, so that the set load applied to the wire 24 by the load generators 21 and 23 may be determined.

In one example, the controller 8 may sense the retraction of the wire 24 during the process of increasing the load applied to the wire 24 by the load generators 21 and 23. That is, the controller 8 may sense, via the encoder 262 of the sensor 26, that the wire 24 that has been extended is retracted (step S160). In this regard, the controller 8 may continuously increase the load by the load generators 21 and 23 when the retraction of the wire 24 is not sensed.

In one example, when the encoder 262 of the sensor 26 senses the retraction of the wire 24, the controller 8 may set a load applied to the wire by the load generators 21 and 23 at a time point when the wire 24 is retracted as the set load.

That is, the user may select a load with which the user wants to perform the exercise as the load applied to the wire by the load generators 21, 23 increases and retract the wire 24 to set the exercise load, or the exercise load may be set with a maximum load with which the user is able to perform the exercise as the wire 24 is retracted because the user is not able to withstand the reaction force of the wire 24 resulted from the load that the user is not able to withstand in the process of increasing the load applied to the wire 24 by the load generators 21 and 23 (step S170).

In this regard, the controller 8 may reduce the load generated by the load generators 21 and 23 to the minimum load when the exercise load is set as the wire 24 is retracted. Therefore, the wire 24 for which the exercise load is set may be gradually retracted into the exercise equipment 100 by the minimum load generated by the load generators 21 and 23, or maintained in the extended state where the user may perform the exercise.

In one example, the controller 8 may display the set load set by the user on the status display 72 or the load display 73 of the exercise equipment 100. That is, the controller 8 may numerically display the set load set by the user on the status display 72 or quantitatively on the load display 73.

In this regard, the set load displayed on the load display 73 may be quantitatively displayed in proportion to a magnitude of the set load. In the embodiment of the present disclosure, the multiple LEDs constituting the load display 73 may be sequentially turned on to display the set load.

In addition, the set load displayed on the load display 73 may be displayed in a different color from the exercise load sensed by the encoder when the user extends or retracts the wire. This will be described in detail in a description of the performing of the exercise (step S300).

In one example, the controller 8 sequentially reduces the magnitude of the load generated from the load generators when the setting of the set load is completed based on the wire retraction of the user (step S180).

Hereinafter, with reference to FIG. 8, the performing of the exercise based on the set load of the exercise equipment 100 (step S300) will be described in detail.

In one example, as described above, the exercise equipment 100 using the wire 24 includes the warm-up area for entering the exercise area and the excessive exercise area in addition to the actual exercise area using the wire 24.

In this regard, the warm-up area is an area included in a process of extending the wire 24 using a posture before the user takes the posture to perform the exercise.

The user's posture in such warm-up area is a posture before the user takes the correct exercise posture. In such posture, the user may consume power unnecessarily when the set load acts on the wire 24 that the user extends.

In addition, the user's posture in the warm-up area is the posture before the user takes the correct exercise posture. Such posture is an incorrect posture that may put strain on joints or muscles of the user when the set load acts on the wire 24 that the user extends.

Therefore, in the warm-up area before entering the exercise area, the magnitude of the load generated by the load generators 21, 23 needs to be smaller than that of the set load.

On the other hand, the excessive exercise area is an area when the wire is excessively extended beyond the extended length of the wire 24 corresponding to the exercise area.

Such an excessive exercise area is the area when the user excessively extends the wire 24. In such area, the user may not be able to take the correct exercise posture. Therefore, when the wire 24 is extended by the length corresponding to the excessive exercise area, it is necessary to make the user aware of this.

After the set load is set by the user, the user may use the exercise equipment 100 using the wire 24 by repeating the extension and retraction operations of the wire 24 within the range of the exercise area.

Therefore, in the aforementioned warm-up area, exercise area, and excessive exercise area, it is necessary to vary the magnitude of the load applied to the wire by the load generators.

First, after the set load is set by the user, the sensor 26 senses the extension of the wire 24 as the user extends the wire 24 for the exercise (step S310).

In one example, the controller 8 senses the extended length of the wire 24 via the encoder 262 of the sensor 26 as the extension of the wire 24 is sensed (step S322), and determines whether the length of the wire 24 extended by the user corresponds to the warm-up area (step S324).

In this regard, the controller 8 determines whether the extended length of the wire 24 corresponds to the warm-up area as the extended length of the wire 24 is sensed, and waits while the wire 24 is extended until reaching the warm-up area.

Thereafter, when the length of the wire extended by the user reaches the warm-up area, the controller 8 controls the load generators 21 and 23 to generate a warm-up load corresponding to the warm-up area (step S326).

In this regard, the warm-up load generated by the load generators 21 and 23 in the warm-up area may be a load having a magnitude between a magnitude of the minimum load that may be generated by the load generators 21 and 23 and the magnitude of the set load set by the user. Preferably, the load generated by the load generators 21 and 23 in the warm-up area may be set to have a magnitude within a range from 10 to 50% of the magnitude of the set load set by the user.

Therefore, in extending the wire 24 in the warm-up area, the user may extend the wire 24 that receives the load having the magnitude smaller than that of the set load, and may extend the wire 24 with less strain on the joints and muscles in the posture before taking the posture to perform the exercise.

Thereafter, the controller 8 may sense the extended length of the wire that has passed through the warm-up area. That is, as the user extends the wire for the actual exercise, the sensor 26 senses the extension of the wire 24 (step S332).

In one example, the controller 8 senses the extended length of the wire 24 via the encoder 262 of the sensor 26 as the extension of the wire 24 is sensed (step S332), and determines whether the length of the wire 24 extended by the user corresponds to the exercise area (step S334).

In this regard, the controller 8 determines whether the extended length of the wire 24 corresponds to the exercise area as the extended length of the wire 24 is sensed, and waits while the wire 24 is extended until reaching the exercise area.

Thereafter, when the length of the wire extended by the user reaches the warm-up area, the controller 8 controls the load generators 21 and 23 to generate the exercise load corresponding to the exercise area (step S336). In this regard, the exercise load generated by the load generators 21 and 23 in the exercise area may be the set load set in the setting of the set load (step S100) described above.

Therefore, in extending the wire 24 in the exercise area, the user may perform the exercise based on the set load by repeatedly extending and retracting the wire 24 to which the set load is given in the correct posture.

In this regard, the controller 8 continuously senses the extended and retracted lengths of the wire 24 to which the set load set by the user is given, and determines whether the extended and retracted lengths of the wire 24 are included in the exercise area (Step S337).

In this regard, when lengths of the wire extended and retracted by the user are included in the exercise area, the controller 8 determines that the user is performing the normal exercise, and allows the load generators 21 and 23 to continuously generate the load based on the set load.

In this regard, the controller may display an amount of change in the length of the wire 24 on the status display 72 or the load display 73 of the exercise equipment 100, based on a change in the lengths of the wire 24 extended and retracted by the user (step S338).

That is, the controller 8 may numerically display the change in the length of the wire 24 extended and retracted by the user on the status display 72 or quantitatively on the load display 73.

In this regard, the amount of change in the length of the wire 24 displayed on the load display 73 may be quantitatively displayed in proportion to the change in length of the wire 24. In the embodiment of the present disclosure, the amount of change may be displayed by sequentially turning on the multiple LEDs constituting the load display 73.

That is, when the user extends the wire 24, the LEDs of the load display 73 may be sequentially turned on or changed in color so as to be increased in number based on the extended length of the wire 24. When the user retracts the wire 24, the LEDs of the load display 73 may be sequentially turned off or changed in color so as to be decreased in number based on the retracted length of the wire 24.

In addition, the amount of change in the length of the wire 24 displayed on the load display 73 may be displayed in a different color from that of the set load displayed on the load display 73. That is, when the set load displayed on the load display 73 is displayed in a specific color, the amount of change in the length of the wire 24 may be displayed in a color different from the specific color in an overlapping manner.

In one example, in the determining of whether the extended and retracted lengths of the wire 24 are included in the exercise area (step S337), the controller 8 determines whether the retracted length of the wire 24 is included in an area smaller than the exercise area based on the retraction of the wire 24 (step S339). That is, the controller 8 may additionally determine that the wire 24 is completely retracted when the user ends the exercise using the wire 24 to which the set load is given in the exercise area.

In this regard, when the user completely retracts the wire 24 into the exercise equipment 100, the controller 8 may determine that the user's exercise is ended and stop the operation of the exercise equipment 100. On the other hand, when the user does not completely retract the wire 24 into the exercise equipment 100, the controller 8 may determine that the exercise continues (step S352).

In one example, when determining that the wire 24 is not completely retracted into the exercise equipment 100 and the exercise continues, the controller 8 may repeatedly perform the exercise load setting process using the exercise area and the exercise area determination process (steps S332 to S338) described above.

In one example, when determining in the determining of whether the retracted length of the wire 24 is included in the area smaller than the exercise area based on the retraction of the wire 24 (step S339) that the extended length of the wire 24 is out of the exercise area, the controller 8 determines whether the extended length of the wire 24 is included in the excessive exercise area (step S342).

In this regard, when determining in the determining of whether the extended length of the wire 24 is included in the excessive exercise area (step S342) that the extended length of the wire 24 is not included in the excessive exercise area, the controller 8 may repeatedly perform the exercise load setting process using the exercise area and the exercise area determination process (steps S332 to S338) described above.

Therefore, the user may continue the exercise by extending and retracting the wire 24 using the set load given to the wire 24 by the load generators 21 and 23.

On the other hand, when determining in the determining of whether the extended length of the wire 24 is included in the excessive exercise area (step S342) that the extended length of the wire 24 is included in the excessive exercise area, the controller 8 controls the load generators 21 and 23 to temporarily generate the exercise load corresponding to the excessive exercise area (step S344). In this regard, the exercise load generated by the load generators 21 and 23 in the excessive exercise area may be a relatively greater load than the set load set in the setting of the set load (step S100) described above.

In this regard, the excessive exercise load generated by the load generators 21 and 23 in the excessive exercise area may be the load greater than the set load set by the user. Preferably, the load generated by the load generators 21 and 23 in the excessive exercise area may be set to have a magnitude within a range from 110 to 130% of the magnitude of the set load set by the user.

Therefore, in extending the wire 24 in the excessive exercise area out of the exercise area, the user extends the wire 24 that receives the load with the magnitude relatively greater than that of the set load.

That is, the user may recognize that the extension range of the extended wire 24 is out of the normal exercise area based on the load applied to the wire, and may return to the exercise area, which is the normal exercise range, by retracting the wire. Accordingly, the poor exercise posture and the injury resulted from the excessive extension of the wire 24 may be prevented in advance.

In addition, the controller 8 may reduce the load temporarily increased based on the extension of the wire 24 by the user included in the excessive exercise area to a load with a smaller magnitude (step S346).

That is, when the wire given with the load with the relatively great magnitude is continuously extended as the user extends the wire 24 in the excessive exercise area out of the exercise area, the user may apply a continuous force to overcome the load applied to the wire 24, so that the exercise posture may become unstable or the muscles may be strained because of the excessive load.

Therefore, the controller 8 may temporarily generate the exercise load corresponding to the excessive exercise area (step S344) and then control the load generators 21 and 23 after a certain period of time (about 3 to 5 seconds) to reduce the load applied to the wire 24. In this regard, the load generated by the load generators 21 and 23 may be the minimum load that may be generated by the load generators 21 and 23 or a load having a magnitude similar to that of the minimum load (preferably, within the range from 10 to 50% of the magnitude of the set load).

Therefore, in extending the wire 24 in the excessive exercise area, the user may retract the wire 24 that receives the load with the magnitude smaller than that of the set load. That is, the user may retract the wire 24 that has been extended by the length corresponding to the excessive exercise area to have the length corresponding to the exercise area to correct the posture thereof to the correct exercise posture.

That is, the user may easily recognize, with the increase in the load applied to the wire 24 by the load generators, that the wire 24 is extended to have the length corresponding to the excessive exercise area, and may easily retract the wire 24 to have the length corresponding to the exercise area as the load that has been applied to the wire 24 in the increasing manner decreases.

Therefore, the user may easily retract the wire 24 and correct the posture to the correct exercise posture to return the wire 24 to the exercise area, and retract the wire 24 with less strain on the joints and the muscles.

In one example, after the temporary generating of the exercise load (step S344) and the reducing of the temporarily increased load to the load with the smaller magnitude (step S346), the controller 8 may sense the extension and the retraction of the wire 24 by the user to determine that the user returns to the exercise area from the excessive exercise area (step S349).

In this regard, when the user does not return the length of the wire 24 extended to the excessive exercise area to the length of the wire 24 corresponding to the exercise area, the temporary generating of the exercise load (step S344) and the reducing of the temporarily increased load to the load with the smaller magnitude (step S346) described above may be repeatedly performed.

On the other hand, when the user returns the length of the wire 24 extended to the excessive exercise area to the length of the wire 24 corresponding to the exercise area, the retracted state of the wire 24 may be determined (step S352).

That is, when the user completely retracts the wire 24, it may be determined that the use of the exercise equipment 100 is ended, and when the user does not completely retract the wire 24, it may be determined that the use of the exercise equipment 100 will continue.

In this regard, when determining that the wire 24 is not completely retracted in the determining of the retracted state of the wire 24 (step S352), the controller 8 may repeatedly perform the exercise load setting process using the exercise area and the exercise area determination process (steps S332 to S338) described above.

Therefore, the user may continue the exercise by extending and retracting the wire 24 using the set load given to the wire 24 by the load generators 21 and 23.

According to the exercise equipment 100 and the method for controlling the exercise equipment 100 according to the present disclosure as described above, when using the exercise equipment 100, the user may easily set the set load applied to the wire via the extension process of the wire.

In addition, according to the exercise equipment 100 and the method for controlling the exercise equipment 100 according to the present disclosure as described above, in performing the exercise using the extension and the retraction of the wire 24, as the different loads are provided in the warm-up area, the exercise area, and the excessive exercise area, imbalance in the exercise posture and damage to the muscles or the joints that may occur in the process in which the user extends and retracts the wire 24 may be prevented.

In addition, according to the exercise equipment 100 and the method for controlling the exercise equipment 100 according to the present disclosure as described above, as the set load set by the user for the exercise using the wire and the exercise load generated as the exercise is performed are quantitatively displayed, the user may visually check an amount of exercise.

As described above, the preferred embodiment of the present disclosure has been described in detail, but those of ordinary skill in the art to which the present disclosure belongs may modify the present disclosure in various ways without departing from the spirit and the scope of the present disclosure defined in the appended claims. Accordingly, future changes in the embodiments of the present disclosure will not deviate from the description of the present disclosure.

The invention claimed is:

1. A method for controlling an exercise equipment including a main body forming an external shape of the exercise equipment, an extendable/retractable wire configured to be disposed inside the main body and exposed to the outside of the main body, a load generator configured to provide a set load when the wire is extended/retracted, a power supply configured to supply power to the load generator, and a controller configured to control the power supply and the load generator, the method comprising:

an exercise load setting step of setting the set load by determining the retraction of the wire while increasing a load generated by the load generator as the wire is extended;

an exercise start determining step of determining start of exercise based on the extension of the wire;

an exercise load varying step of reducing or increasing the load generated by the load generator based on a change in a length of the wire; and an exercise end determining step of determining whether the exercise is in progress and whether the exercise is ended by sensing the length and the retracted state of the wire, wherein an extended length of the wire is divided into a warm-up area, an exercise area, and an excessive exercise area based on an exercise range of a user, and wherein the exercise load varying step of reducing or increasing the load generated by the load generator includes:

generating, by the load generator, a load smaller than the set load when the extended length of the wire is included in the warm-up area;

generating, by the load generator, the set load when the extended length of the wire is included in the exercise area; and generating, by the load generator, a load greater than the set load when the extended length of the wire is included in the excessive exercise area.

2. The method of claim 1, wherein the exercise load setting step includes:

sensing the extension of the wire;

sensing stop of the extension of the wire;

increasing the load generated by the load generator;

sensing the retraction of the wire; and setting the load of the load generator as the set load when the wire is retracted.

3. The method of claim 2, wherein the increasing of the load generated by the load generator includes increasing the load at a constant speed from a minimum load of the load generator.

4. The method of claim 3, wherein the sensing of the retraction of the wire is performed during the increasing of the load generated by the load generator.

5. The method of claim 3, wherein the sensing of the retraction of the wire includes reducing the load generated by the load generator to the minimum load when the retraction of the wire is sensed.

6. The method of claim 2, wherein the sensing of the extension of the wire includes sensing that the wire is extended by a length corresponding to an exercise area corresponding to an exercise range of a user.

7. The method of claim 6, wherein the sensing of the stop of the extension of the wire includes sensing that the extension of the wire is stopped for a predetermined period of time after the wire is extended by the length corresponding to the exercise area.

8. The method of claim 3, wherein the sensing of the retraction of the wire includes setting the load generated by the load generator when the retraction of the wire is sensed as the set load.

9. The method of claim 1, wherein the generating of the set load includes determining whether the extended length of the wire is included in the exercise area, and waiting while the wire is extended until the extended length of the wire is included in the exercise area.

10. The method of claim 9, wherein the exercise equipment further includes the load display including multiple LEDs arranged along an extension direction of the wire and configured to quantitatively display the set load thereon, wherein the exercise equipment displays the change in the length of the wire based on the extension and the retraction of the wire in the exercise area on the load display in a manner of overlapping the set load displayed on the load display.

11. The method of claim 10, wherein the exercise equipment further includes the load display including multiple LEDs arranged along an extension direction of the wire and configured to quantitatively display the set load thereon, wherein the exercise equipment displays the load generated by the load generator in the warm-up area on the load display in a manner of overlapping the set load displayed on the load display.

12. The method of claim 1, wherein the exercise equipment further includes a load display configured to quantitatively display the set load thereon, and the set load is displayed on the load display as being set.

13. The method of claim 12, wherein the load display includes multiple LEDs arranged along an extension direction of the wire, and the set load is displayed via sequential lighting of the LEDs.

14. The method of claim 1, wherein in the generating of the load greater than the set load, when it is determined that the extended length of the wire is included in the excessive exercise area, the load generated by the load generator has a magnitude within a range from 110 to 130% of the set load.

15. The method of claim 14, wherein a load generated by the load generator after the generating of the load greater than the set load is reduced in a magnitude to a magnitude within a range from 10 to 50% of the set load.

16. The method of claim 1, wherein the generating of the load smaller than the set load includes determining whether the extended length of the wire is included in the warm-up area and waiting until the extended length of the wire is included in the warm-up area.

17. The method of claim 1, wherein the load generated by the load generator has a magnitude within a range from 10 to 50% of the set load.

* * * * *